US009470024B2

(12) United States Patent
Knight et al.

(10) Patent No.: US 9,470,024 B2
(45) Date of Patent: Oct. 18, 2016

(54) CLOSURE ASSEMBLIES FOR MOVABLE PARTITIONS, MOVABLE PARTITION SYSTEMS INCLUDING CLOSURE ASSEMBLIES AND RELATED METHODS

(71) Applicant: Won-Door Corporation, Salt Lake City, UT (US)

(72) Inventors: Tracy M. Knight, Kearns, UT (US); Michael D. George, Kaysville, UT (US); W. Michael Coleman, Salt Lake City, UT (US); John G. Garrett, III, Magna, UT (US)

(73) Assignee: Won-Door Corporation, Salt Lake City, UT (US)

( * ) Notice: Subject to any disclaimer, the term of this patent is extended or adjusted under 35 U.S.C. 154(b) by 178 days.

(21) Appl. No.: 14/149,441

(22) Filed: Jan. 7, 2014

(65) Prior Publication Data

US 2014/0116633 A1 May 1, 2014

Related U.S. Application Data

(62) Division of application No. 12/859,126, filed on Aug. 18, 2010, now Pat. No. 8,627,618.

(51) Int. Cl.
*E05D 15/06* (2006.01)
*E05C 19/02* (2006.01)
(Continued)

(52) U.S. Cl.
CPC ..... *E05C 19/024* (2013.01); *E05B 65/0085* (2013.01); *E05B 65/104* (2013.01);
(Continued)

(58) Field of Classification Search
CPC ..... E05C 19/024; E05B 65/104; E05B 65/0085; E05D 15/12; Y10T 292/08; Y10T 292/0908; E05Y 2600/62; E05Y 2900/142; E05Y 2900/134; E05Y 2201/22
USPC ..... 160/199, 206, 213, 202, 6, 196.1, 160/84.06; 292/130, 183, 230, 163, 175, 292/32, 33, DIG. 66; 49/394, 466; 70/95–100
See application file for complete search history.

(56) References Cited

U.S. PATENT DOCUMENTS 2,717,064 A * 9/1955 Hock ..... 49/394
3,094,199 A * 6/1963 Wallmann ..... 49/1
(Continued)

OTHER PUBLICATIONS

International Search Report and Written Opinion for International Patent Application No. PCT/US2011/044387, mailed Mar. 22, 2012.

*Primary Examiner* — Syed A Islam
*Assistant Examiner* — Jeremy Ramsey
(74) *Attorney, Agent, or Firm* — TraskBritt

(57) ABSTRACT

Closure assemblies for movable partitions may include a leading end assembly having a first side and a second side and a latching assembly coupled thereto. The latching assembly may include a first latching member having a portion thereof positioned proximate to the first side and a second latching member having a portion thereof positioned proximate to the second side. Movable partition systems may include a plurality of hingedly coupled panels movably coupled to a track, and a leading end assembly coupled to at least one panel of the plurality of hingedly coupled panels. The leading end assembly may include at least two latching features positioned on the leading end assembly. Methods of securing a movable partition may include retaining a first latching member and a second latching member in a retracted position and extending the first latching member and the second latching member to an extended position.

20 Claims, 7 Drawing Sheets

(51) Int. Cl.
*E05B 65/00* (2006.01)
*E05B 65/10* (2006.01)
*E05D 15/12* (2006.01)

(52) U.S. Cl.
CPC ..... *E05D 15/12* (2013.01); *E05Y 2201/22* (2013.01); *E05Y 2600/62* (2013.01); *E05Y 2900/134* (2013.01); *E05Y 2900/142* (2013.01); *Y10T 292/08* (2015.04); *Y10T 292/0908* (2015.04)

(56) References Cited

U.S. PATENT DOCUMENTS 3,325,941 A * 6/1967 Prucha ..... 49/7
3,447,584 A 6/1969 Smart
3,481,388 A 12/1969 Smart
3,509,934 A 5/1970 Smart
3,720,254 A 3/1973 Smart
3,799,237 A 3/1974 Proserpi
3,807,480 A 4/1974 Smart
4,133,364 A 1/1979 Smart
4,189,173 A 2/1980 Rester
4,228,841 A 10/1980 Dixon
4,303,286 A * 12/1981 McClellan ..... 312/409
4,834,161 A 5/1989 Johnson et al.
4,924,929 A 5/1990 Johnson et al.
5,638,639 A 6/1997 Goodman et al.
5,816,309 A 10/1998 Paradise
5,960,157 A 9/1999 McGraw
6,296,038 B1 * 10/2001 Chen ..... 160/199
6,438,912 B1 8/2002 Avent
6,581,345 B2 6/2003 Goldsmith et al.
6,662,848 B2 12/2003 Goodman et al.
6,793,299 B2 * 9/2004 Newberry et al. ..... 312/199
6,935,662 B1 8/2005 Hauber et al.
7,066,297 B2 6/2006 Goodman et al.
7,308,973 B2 12/2007 Dziwak
7,353,637 B2 4/2008 Harger et al.
7,448,426 B2 11/2008 Hsieh
2006/0076783 A1 4/2006 Tsai
2007/0029053 A1 2/2007 Hirofumi
2008/0006594 A1 1/2008 Layton
2008/0105387 A1 5/2008 Coleman et al.
2008/0105389 A1 5/2008 Goodman et al.
2008/0115896 A1 5/2008 Goodman
2008/0169069 A1 * 7/2008 Coleman ..... E06B 3/94 160/199
2009/0044918 A1 2/2009 Goodman et al.
2011/0000625 A1 1/2011 George

* cited by examiner

CLOSURE ASSEMBLIES FOR MOVABLE PARTITIONS, MOVABLE PARTITION SYSTEMS INCLUDING CLOSURE ASSEMBLIES AND RELATED METHODS

CROSS-REFERENCE TO RELATED APPLICATION

This application is a division of U.S. patent application Ser. No. 12/859,126, filed Aug. 18, 2010, now U.S. Pat. No. 8,627,618, issued Jan. 14, 2014 the disclosures of each of which is hereby incorporated herein by this reference in its entirety.

TECHNICAL FIELD

Embodiments of the invention relate to closure assemblies for movable partitions. In particular, embodiments of the invention relate to closure assemblies for movable partitions, movable partition systems including closure assemblies and methods of securing movable partitions.

BACKGROUND

Movable partitions are utilized in numerous situations and environments for a variety of purposes. Such partitions may include, for example, a movable partition comprising foldable or collapsible doors configured to enclose or subdivide a room or other area. Often, such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security barrier, a fire barrier, or both a security barrier and a fire barrier. In such a case, the partition barrier may be configured to automatically close upon the occurrence of a predetermined event such as the actuation of an associated alarm. For example, one or more accordion or similar folding-type partitions may be used as a security barrier, a fire barrier, or both a security barrier and a fire barrier wherein each partition is formed with a plurality of panels connected to one another with hinges. The hinged connection of the panels allows the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other reason, the partition may be extended along an overhead track, which is often located above the movable partition in a header assembly, until the partition extends a desired distance across the room.

When deployed, a leading end of the movable partition, often defined by a component known as a lead post, complementarily engages a receptacle in a fixed structure, such as a wall, or engages a mating receptacle of another door. Such a receptacle may be referred to as a door jamb or a door post when formed in a fixed structure, or as a mating lead post when formed in another movable partition. It is desirable that the lead post be substantially aligned with the mating receptacle such that the movable partition may be completely closed and an appropriate seal formed between the movable partition and the mating receptacle.

When implemented as a fire barrier, movable partitions may be constructed to meet certain specifications relating to fire resistance and may be utilized as fire barrier doors in condominiums, apartments, office building, high-rise buildings, casinos, malls, or any other location where desired or required by fire codes. The movable partitions are normally open and, when a fire is sensed, are automatically closed. For example, the movable partition may be motor driven so that in the event of a fire, which may be sensed by a fire sensing system, the movable partition automatically closes to provide a fire barrier. As mentioned above, the leading end of the lead post assembly of the movable partition may fit into a receiving recess (e.g., a female door post) at the opposite side of the room from where the movable partition is stored. The lead post assemblies of such movable partitions and door post assemblies are generally constructed of a single metal channel or of metal pieces connected directly together along large contact areas such that heat is readily transmitted through the lead post assembly and door post assembly.

BRIEF SUMMARY

In some embodiments, the present invention includes a closure assembly for a movable partition. The closure assembly may include a leading end assembly having a first side and a second side opposing the first side and a latching assembly coupled to the leading end assembly. The latching assembly may include a first latching member having a portion thereof positioned proximate to the first side of the leading end assembly and a second latching member having a portion thereof positioned proximate to the second side of the leading end assembly.

In additional embodiments, the present invention includes a movable partition system. The movable partition assembly may include a plurality of hingedly coupled panels movably coupled to a track, a leading end assembly coupled to at least one panel of the plurality of hingedly coupled panels, and an opposing wall closure assembly positioned proximate to an end portion of the track. The leading end assembly may have a leading surface that is at least substantially planar and may include at least two latching features positioned on at least one side of the leading end assembly.

In yet additional embodiments, the present invention includes a method of securing a movable partition. The method may include retaining a first latching member and a second latching member in a retracted position and extending the first latching member and the second latching member to an extended position. Extending the first latching member and the second latching member may include extending the first latching member in a first direction to engage with an opening formed in a receiving assembly and extending the second latching member in a second direction to engage with another opening formed in the receiving assembly.

BRIEF DESCRIPTION OF THE DRAWINGS

While the specification concludes with claims particularly pointing out and distinctly claiming what are regarded as embodiments of the present invention, the advantages of embodiments of the invention may be more readily ascertained from the description of example embodiments of the invention set forth below when read in conjunction with the accompanying drawings, in which:

DETAILED DESCRIPTION

Illustrations presented herein are not meant to be actual views of any particular device or system, but are merely idealized representations which are employed to describe embodiments of the present invention. Additionally, elements common between figures may retain the same numerical designation.

Figure 1:
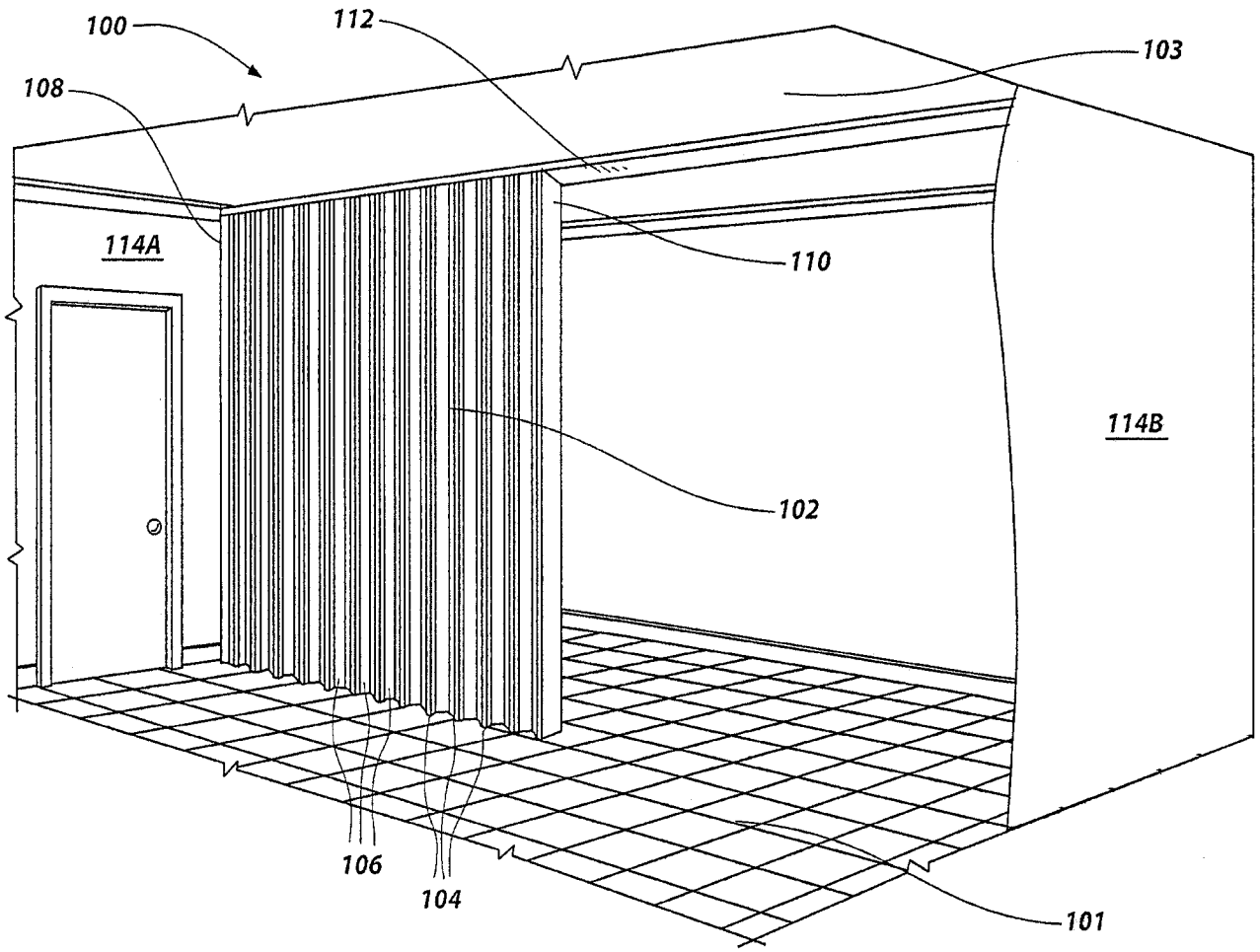
FIG. 1 is a perspective view of an embodiment of a movable partition system of the present invention including a closure assembly in accordance with an embodiment of the present invention.

Referring to FIG. 1, a system 100 is shown, which may also be referred to as a movable partition system 100, including a movable partition 102 in the form of an accordion-type door. The movable partition 102 may be used as a barrier (e.g., a security barrier, a fire barrier, or both a security barrier and a fire barrier). In other embodiments, the movable partition 102 may be used, for example, to subdivide a relatively larger space into relatively smaller spaces (e.g., rooms or areas). The movable partition 102 may be formed with a plurality of panels 106 that are connected to one another with hinges or other hinge-like members 104 to form a pleated (i.e., a plicated) structure. The movable partition 102 is engaged with (e.g., suspended from) an overhead track 112 along which the movable partition 102 moves as the movable partition 102 is extended (i.e., closed) and retracted (i.e., opened). The hinged connection of the panels 106 allows the movable partition 102 to be compactly stored in a movable partition storage area such as, for example, a storage pocket 108 formed in a wall 114A of a building when in a retracted or folded state.

To deploy the movable partition 102 to an extended position, the movable partition 102 is moved along the overhead track 112 to an adjoining structure positioned at an end portion of the overhead track 112. A leading end structure of the movable partition 102 may include a leading end assembly 110 configured to engage with an adjoining structure such as, for example, an opposing wall 114B, a door jamb, or a leading end assembly of another movable partition (not shown). In some embodiments, the leading end assembly 110 may be similar to the leading end assemblies described in, for example, U.S. patent application Ser. No. 12/497,310, which was filed Jul. 2, 2009 and entitled "Movable Partitions, Leading End Assemblies for Movable Partitions and Related Methods," which is assigned to the assignee hereof and the disclosure of which is incorporated herein in its entirety by this reference. While the embodiment of the movable partition 102 shown and described with reference to FIG. 2 contains a single accordion-type door, additional embodiments of the present invention may include multiple doors. For example, a partition may include two doors (e.g., accordion-type doors) configured to extend across a space and join together to partition a space.

Figure 2:
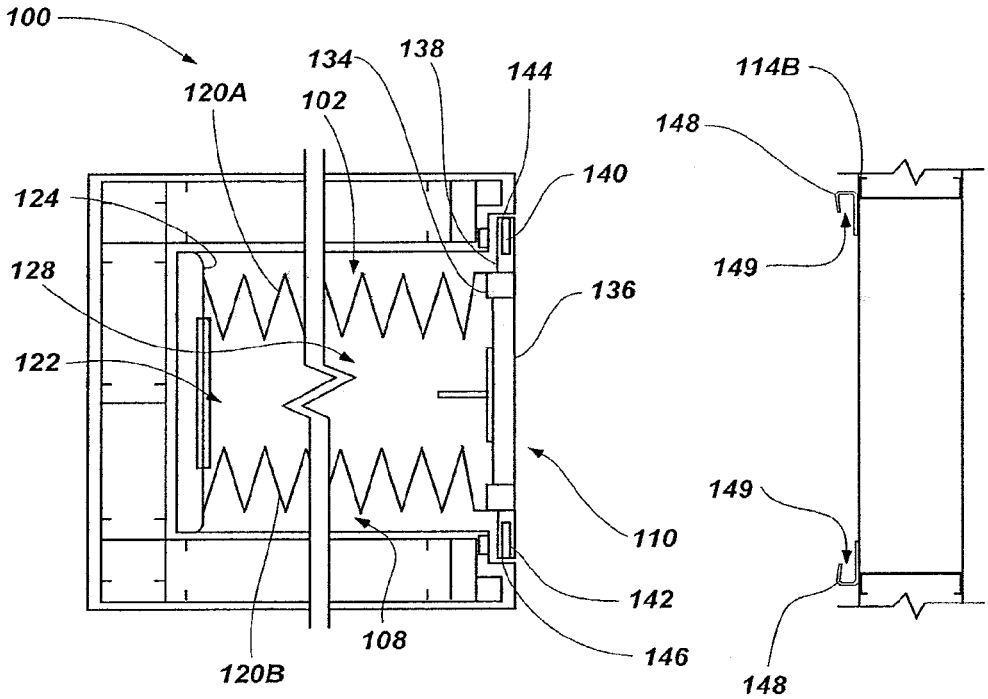
FIG. 2 is a partial cross-sectional top view of the movable partition system of FIG. 1 shown in a retracted state.

Referring to FIG. 2, the movable partition system 100 is shown in a partial cross-sectional view in a retracted state. As shown in FIG. 2, a movable partition system 100 may comprise an accordion-style movable partition 102 that may include a first accordion-style structure 120A and a second accordion-style structure 120B that is laterally spaced from, and extends generally parallel to, the first structure 120A. Each of the two structures 120A and 120B has a trailing end 122 structurally fixed to a jamb such as, for example, a floating jamb 124 that is movable within the pocket 108, and a leading end 128 that is attached to the leading end assembly 110.

When the movable partition 102 is in a retracted state, the movable partition 102 may be stored in the pocket 108 formed by one or more walls. For example, as shown in FIG. 2, the pocket 108 may be provided by one or more walls extending substantially parallel to each other and extending between a floor 101 and a ceiling 103 (FIG. 1).

The leading end assembly 110 may comprise a leading portion such as, for example, a leading surface 136 that may be positioned adjacent to (e.g., in abutment with) an adjoining structure such as, for example, an opposing wall 114B or the leading end assembly of another movable partition (not shown). As used herein, "leading surface" means a distal surface of the leading end assembly 110 (e.g., the surface of an element located furthest from the point of attachment with the movable partition 102). The leading end assembly 110 may further comprise a trailing portion such as, for example, a trailing surface 138 positioned opposite to the leading surface 136. As used herein, "trailing surface" means a proximal surface of the leading end assembly 110 (e.g., the surface of an element located at the point of attachment with the movable partition 102).

The leading end assembly 110 may include an attachment portion configured to attach to the movable partition 102. For example, the movable partition 102 may be coupled to an attachment portion of the leading end assembly 110 such as, for example, the trailing surface 138 of the leading end assembly 110. In some embodiments, the attachment portion of the leading end assembly 110 may include one or more frame members 134 for coupling the movable partition 102 to the leading end assembly 110. The frame members 134 may be formed in any shape suitable to attach the accordion-style structures 120A, 120B such as, for example, a member having a rectangular shape as shown in FIG. 2 that extends vertically along the leading end assembly 110. As used herein, the term "vertical" references a vertical direction of the leading end assembly 110 as it is installed in a movable partition system 100 (i.e., vertically between the floor 101 and the ceiling 103 shown in FIG. 1). An end of the movable partition 102 (e.g., the leading end 128 of the partitions 120A, 120B) may be coupled to the leading end assembly 110. For example, the movable partition 102 may be coupled to the leading end assembly 110 at the frame members 134 on the trailing surface 138. The movable partition 102 may be coupled to the leading end assembly 110 in any suitable manner including, but not limited to, using adhesives, tongue and groove joints, and fasteners (e.g., screws, bolts, rivets, etc.). The leading end assembly 110 may also be coupled to a trolley (not shown) movably coupled to the overhead track 112 of the movable partition system 100 (FIG. 1). In some embodiments, an upper portion (i.e., a portion of the leading end assembly 110 proximate to the overhead track 112 (FIG. 1)) may be coupled to the trolley.

As further shown in FIG. 2, the leading end assembly 110 may be sized to form a barrier at an open end of the pocket 108 of FIG. 1 (e.g., the end of the pocket 108 through which the movable partition 102 may be extended along the overhead track) when the movable partition 102 is in a retracted state. In some embodiments, the leading end assembly 110 may form a barrier substantially covering the open end of the pocket 108. In some embodiments, the leading surface 136 of the leading end assembly 110 may be substantially flush with a portion of the pocket 108 (e.g., the walls forming the pocket 108) when the movable partition 102 is retracted in a storage position within the pocket 108. In some embodiments, the leading surface 136 may be substantially flat and may be positioned adjacent to the opposing wall 114B. In other embodiments and as discussed below in further detail with regard to FIG. 4, the opposing wall 114B may include a door jamb 118 set into the opposing wall 114B.

Referring still to FIG. 2, the leading end assembly 110 may include a closure assembly to secure the leading end assembly 110 with a portion of the opposing wall 114B. In some embodiments, the closure assembly may secure or otherwise retain the leading end assembly 110 in engagement with the opposing wall 114B upon reaching a predetermined temperature, which may prevent the severe heat from a fire from causing the leading end assembly 110 and the opposing wall 114B to separate, such as due to warping. The closure assembly may include a first latching member 140 and a second latching member 142 positioned on the leading end assembly 110. In some embodiments, the first latching member 140 may be positioned on a first side 144 of the leading end assembly 110 and the second latching member 142 may be positioned on a second side 146 of the leading end assembly 110 that opposes the first side 144 of the leading end assembly 110. In some embodiments, the first and second latching members 140, 142 may be at least partially retained within a portion of the leading end assembly 110 in a retracted position.

The opposing wall 114B may include a closure assembly such as, for example, a receiving assembly including one or more strike moldings 148 having one or more openings 149 formed by or in the strike moldings 148 to receive portions of the first and second latching members 140, 142. The strike moldings 148 may be coupled to a portion of the opposing wall 114B and positioned to have a lateral width greater than that of the leading end assembly 110 to enable the leading end assembly 110 to be positioned adjacent to the opposing wall 114B between the strike moldings 148. It is noted that while the embodiment of FIG. 2 illustrates the strike moldings 148 having a substantially J-shaped cross section, the strike moldings 148 may be formed in any suitable shape enabling the strike moldings 148 to receive a portion of first and second latching members 140, 142 (e.g., a strike molding having a substantially Z-shaped cross section as shown and described with reference to FIG. 12).

Figure 3:
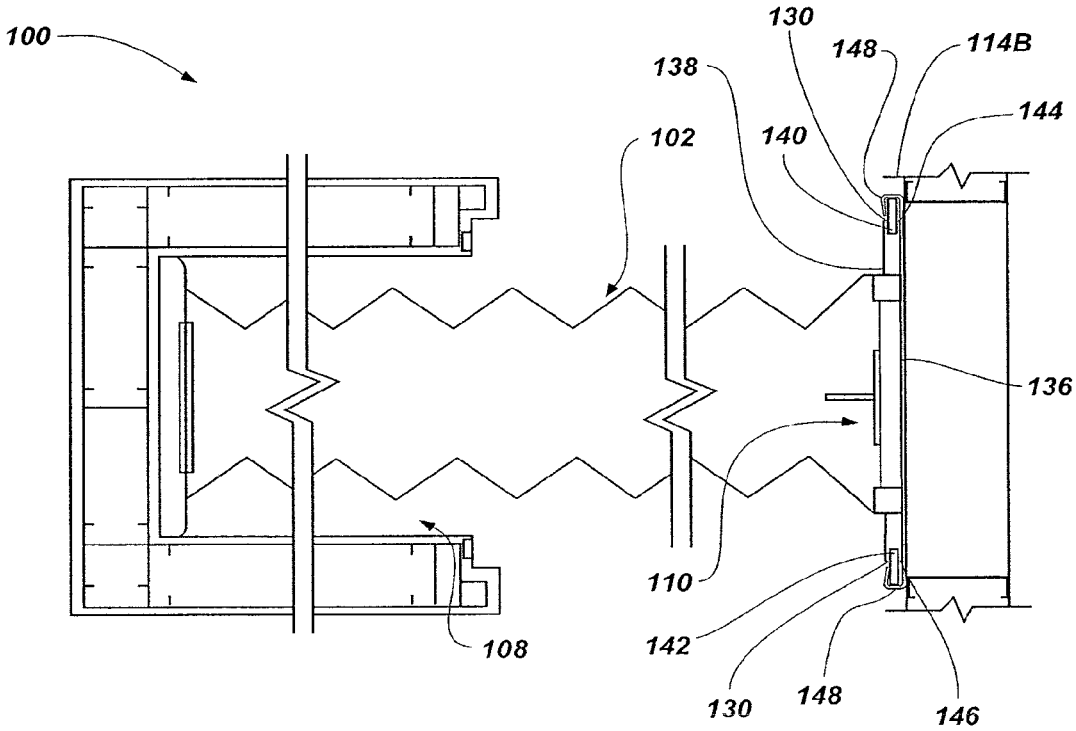
FIG. 3 is a partial cross-sectional top view of the movable partition system of FIG. 2 shown in an extended state.

FIG. 3 is a partial cross-sectional view of the movable partition system 100 of FIG. 2 shown in an extended state. As shown in FIG. 3, the movable partition 102 may be extended along an overhead track 112 (FIG. 1) to a surface of the opposing wall 114B. In the extended state, the leading end assembly 110 of the movable partition 102 may be positioned substantially adjacent to the opposing wall 114B and may be latched or otherwise secured in the extended state by the closure assembly (e.g., the first and second latching members 140, 142) and the closure assembly positioned on the opposing wall 114B (e.g., the receiving assembly). The leading surface 136 may be positioned adjacent to a surface of the opposing wall 114B to form a barrier such as, for example, a fire barrier. In some embodiments, the leading surface 136 of the leading end assembly 110 may be substantially disposed within the opposing wall 114B (e.g., within a door jamb 118 formed by the opposing wall 114B as shown in FIG. 4).

When the movable partition 102 is in the extended state, the first and second latching members 140, 142 may be positioned such that the first and second latching members 140, 142 align with the strike moldings 148. The first and second latching members 140, 142 may be displaced to an extended position through openings 130 in the leading end assembly 110 to be received within the strike moldings 148 to retain the movable partition 102 in the extended state (i.e., in a closed position). For example, the first latching member 140 may extend from the first side 144 of the leading end assembly 110 into an opening 149 (FIG. 2) formed by the one of the strike moldings 148 coupled to the opposing wall 114B proximate to the first side 144 of the leading end assembly 110. In a similar manner, the second latching member 142 may extend from the second side 146 of the leading end assembly 110 into an opening 149 (FIG. 2) formed by one of the strike moldings 148 coupled to the opposing wall 114B proximate to the second side 146 of the leading end assembly 110. When portions of the first and second latching members 140, 142 are received in the strike moldings 148, the leading end assembly 110 is retained in proximity to the opposing wall 114B and the movable partition 102 may not be retracted until the first and second latching members 140, 142 are returned to the retracted state as shown in FIG. 2. In other words, the portions of the first and second latching members 140, 142 that are received in the strike moldings 148 substantially prevent the leading end assembly 110 and, in turn, the movable partition 102 from being moved to a retracted state as portions of the strike moldings 148 block the path of the leading end assembly 110 having portions of the first and second latching members 140, 142 extended therefrom.

Figure 4:
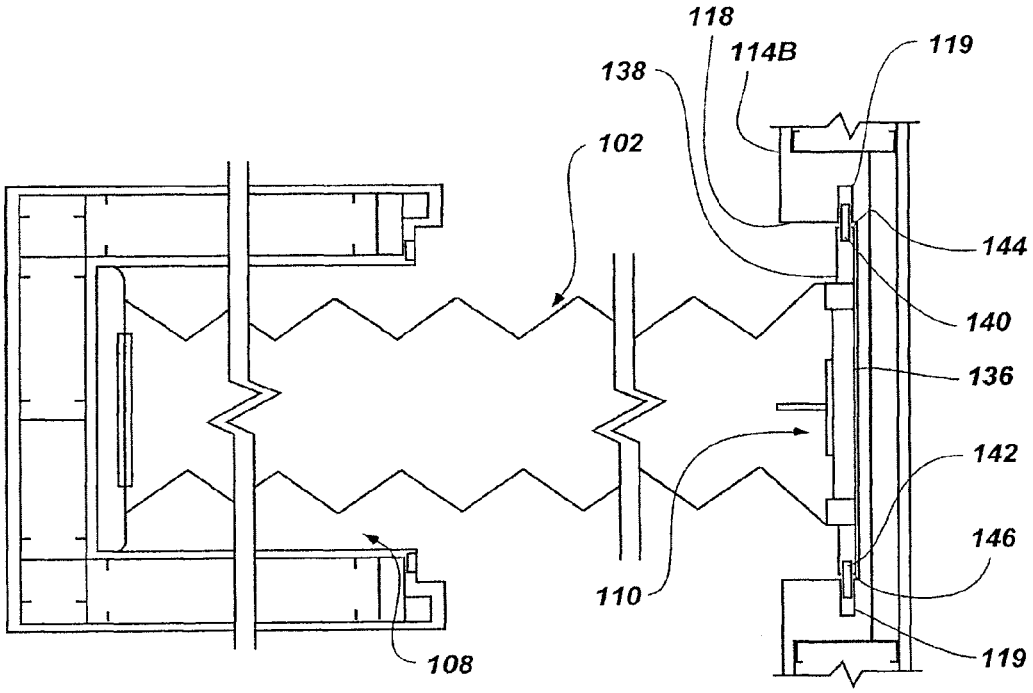
FIG. 4 is a partial cross-sectional top view of a movable partition system including a closure assembly in accordance with another embodiment of the present invention shown in an extended state.

FIG. 4 is a partial cross-sectional view of a movable partition system in accordance with another embodiment of the present invention shown in an extended state. As shown in FIG. 4, the movable partition 102 may be extended along an overhead track 112 (FIG. 1) to a surface of the opposing wall 114B. In some embodiments and as shown in FIG. 4, the opposing wall 114B may include a door jamb 118 formed in the opposing wall 114B. It is noted that while the door jamb 118 formed by the opposing wall 114B shown and described with reference to FIG. 4 is illustrated as a shallow pocket structure, the opposing wall 114B may be any suitable shape and configuration, including a substantially flat surface of an adjoining structure (e.g., as shown in FIG. 2) wherein the leading surface 136 of the leading end assembly 110 may be positioned adjacent to the substantially flat surface of the adjoining structure.

In some embodiments, the receiving assembly may comprise one or more openings 119 formed in the door jamb 118. The first and second latching members 140, 142 may be positioned such that the first and second latching members 140, 142 may align with the openings 119 formed in the door jamb 118. The openings 119 in the door jamb 118 may receive portions of the first and second latching members 140, 142 to selectively retain and secure the movable partition 102 in the extended position (i.e., in a closed position). For example, the first latching member 140 may extend from the first side 144 of the leading end assembly 110 into an opening 119 formed in the door jamb 118 proximate to the first side 144 of the leading end assembly 110. In a similar manner, the second latching member 142 may extend from the second side 146 of the leading end assembly 110 into an opening 119 formed in the door jamb 118 proximate to the second side 146 of the leading end assembly 110. When portions of the first and second latching members 140, 142 are received in openings 119 of the door jamb 118, the leading end assembly 110 is retained in proximity to the opposing wall 114B and the movable partition 102 may not be retracted until the first and second latching members 140, 142 are returned to the retracted state (e.g., as shown in FIG. 2). In other words, the portions of the first and second latching members 140, 142 that are received in the door jamb 118 substantially prevent the leading end assembly 110 and, in turn, the movable partition 102 from being moved to a retracted state as portions of the door jamb 118 block the path of the leading end assembly 110 having portions of the first and second latching members 140, 142 extended therefrom.

Figure 5:
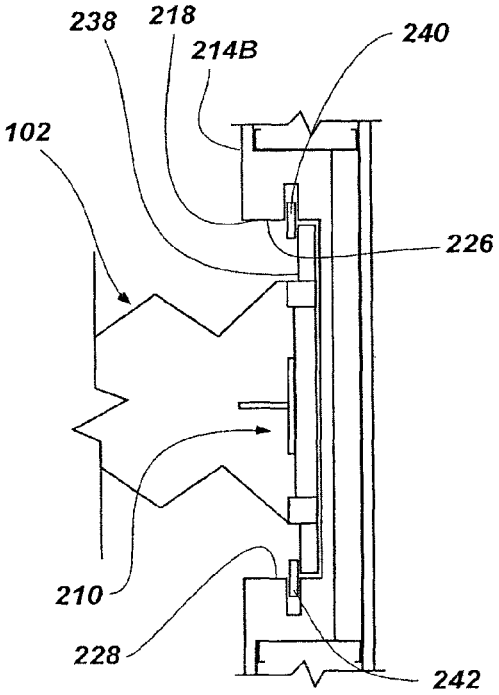
FIG. 5 is a partial cross-sectional top view of a portion of a movable partition system including a closure assembly in accordance with yet another embodiment of the present invention shown in an extended state.

FIG. 5 is a partial cross-sectional view of a portion of a movable partition system in accordance with yet another embodiment of the present invention shown in an extended state. As shown in FIG. 5, an opposing wall 214B may include a closure assembly to secure the leading end assembly 210 with a portion of the opposing wall 214B. For example, the opposing wall 214B may include a door jamb 218 formed in the opposing wall 214B. The door jamb 218 may include a first latching member 240 and a second latching member 242 positioned at least partially in the door jamb 218. In some embodiments, the first latching member 240 may be positioned on a first side 226 of the door jamb 218 and the second latching member 242 may be positioned on a second side 228 of the door jamb 218 that opposes that first side 226 of the door jamb 218. In some embodiments, the first and second latching members 240, 242 may be retained within a portion of the door jamb 218 in a retracted position.

In the extended position, the first latching member 240 may extend from the first side 226 of the door jamb 218 to an area adjacent to a portion of the trailing surface 238 of the leading end assembly 210. In a similar manner, the second latching member 242 may extend from the second side 228 of the door jamb 218 to an area adjacent to a portion of the trailing surface 238 of the leading end assembly 210. When portions of the first and second latching members 240, 242 are disposed adjacent to portions of the trailing surface 238 of the leading end assembly 210, the leading end assembly 210 is retained in proximity to the opposing wall 214B and the movable partition 102 may not be retracted until the first and second latching members 240, 242 are returned to the retracted state. In other words, the portions of the first and second latching members 240, 242 disposed adjacent to portions of the trailing surface 238 of the leading end assembly 210 substantially prevent the leading end assembly 210 and, in turn, the movable partition 102, from being moved to a retracted state as the portions may partially block the path of the leading end assembly 210. In some embodiments, the first and second latching members 240, 242 may at least partially abut the trailing surface 238 of the leading end assembly 210.

Figure 6:
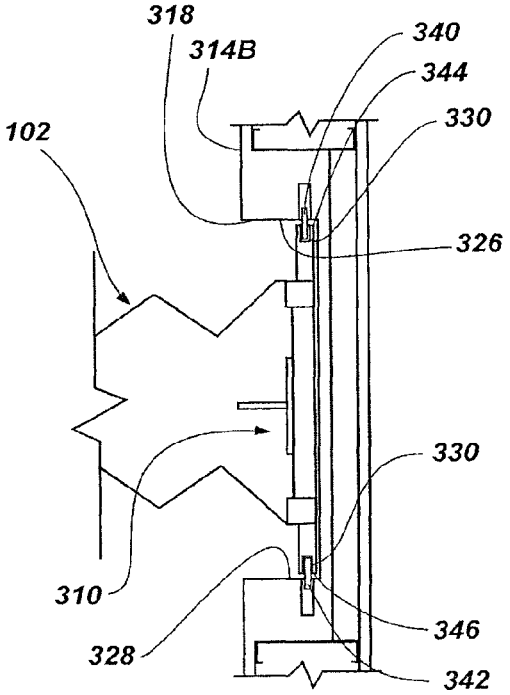
FIG. 6 is a partial cross-sectional top view of a portion of a movable partition system including a closure assembly in accordance with yet another embodiment of the present invention shown in an extended state.

FIG. 6 is a partial cross-sectional view of a portion of a movable partition system in accordance with yet another embodiment of the present invention shown in an extended state. As shown in FIG. 6, an opposing wall 314B may include a closure assembly to secure the leading end assembly 310 with a portion of the opposing wall 314B. For example, the opposing wall 314B may include a door jamb 318 formed in the opposing wall 314B. The door jamb 318 may include a first latching member 340 and a second latching member 342 positioned at least partially in the door jamb 318. In some embodiments, the first latching member 340 may be positioned on a first side 326 of the door jamb 318 and the second latching member 342 may be positioned on a second side 328 of the door jamb 318 that opposes that first side 326 of the door jamb 318. In some embodiments, the first and second latching members 340, 342 may be retained within a portion of the door jamb 318 in a retracted position.

The leading end assembly 310 may include a closure assembly such as, for example, a receiving assembly including one or more openings 330 formed in the leading end assembly 310. The first and second latching members 340, 342 may be positioned such that the first and second latching members 340, 342 may align with the openings 330 formed in the leading end assembly 310. For example, the leading end assembly 310 may include an opening 330 formed in a first side 344 of the leading end assembly 310 and an opening 330 formed in a second, opposing side 346 of the leading end assembly 310. When the first and second latching members 340, 342 are positioned in an extended position, the openings 330 in the leading end assembly 310 may receive portions of the first and second latching members 340, 342 of the door jamb 318 to selectively retain and secure the movable partition 102 in the extended position (i.e., in a closed position). For example, the first latching member 340 may extend from the first side 326 of the door jamb 318 into an opening 330 formed in the leading end assembly 310 proximate to the first side 326 of the door jamb 318. In a similar manner, the second latching member 342 may extend from the second side 328 of the door jamb 318 into an opening 330 formed in the leading end assembly 310 proximate to the second side 328 of the door jamb 318. When portions of the first and second latching members 340, 342 are received in openings 330 of the leading end assembly 310, the door jamb 318 is retained in proximity to the opposing wall 314B and the movable partition 102 may not be retracted until the first and second latching members 340, 342 are returned to the retracted state (e.g., as shown in FIG. 2). In other words, the portions of the first and second latching members 340, 342 disposed in the openings 330 of the leading end assembly 310 substantially prevent the leading end assembly 310 and, in turn, the movable partition 102, from being moved to a retracted state as the portions of the first and second latching members 340, 342 at least partially block the path of the leading end assembly 310.

It is noted that while the embodiments of FIGS. 2 through 6 illustrate latching members positioned on opposing lateral sides of leading end assemblies or door jambs, the latching members may also be positioned on vertical sides (i.e., top and bottom portions) of the leading end assemblies or door jambs. Furthermore, in some embodiments, one or more latching members may be positioned on a single side (e.g., lateral or vertical) of the leading end assemblies or door jambs. In other embodiments, the one or more latching members may be positioned on combinations of lateral and vertical sides of the leading end assemblies or door jambs.

Figure 7:
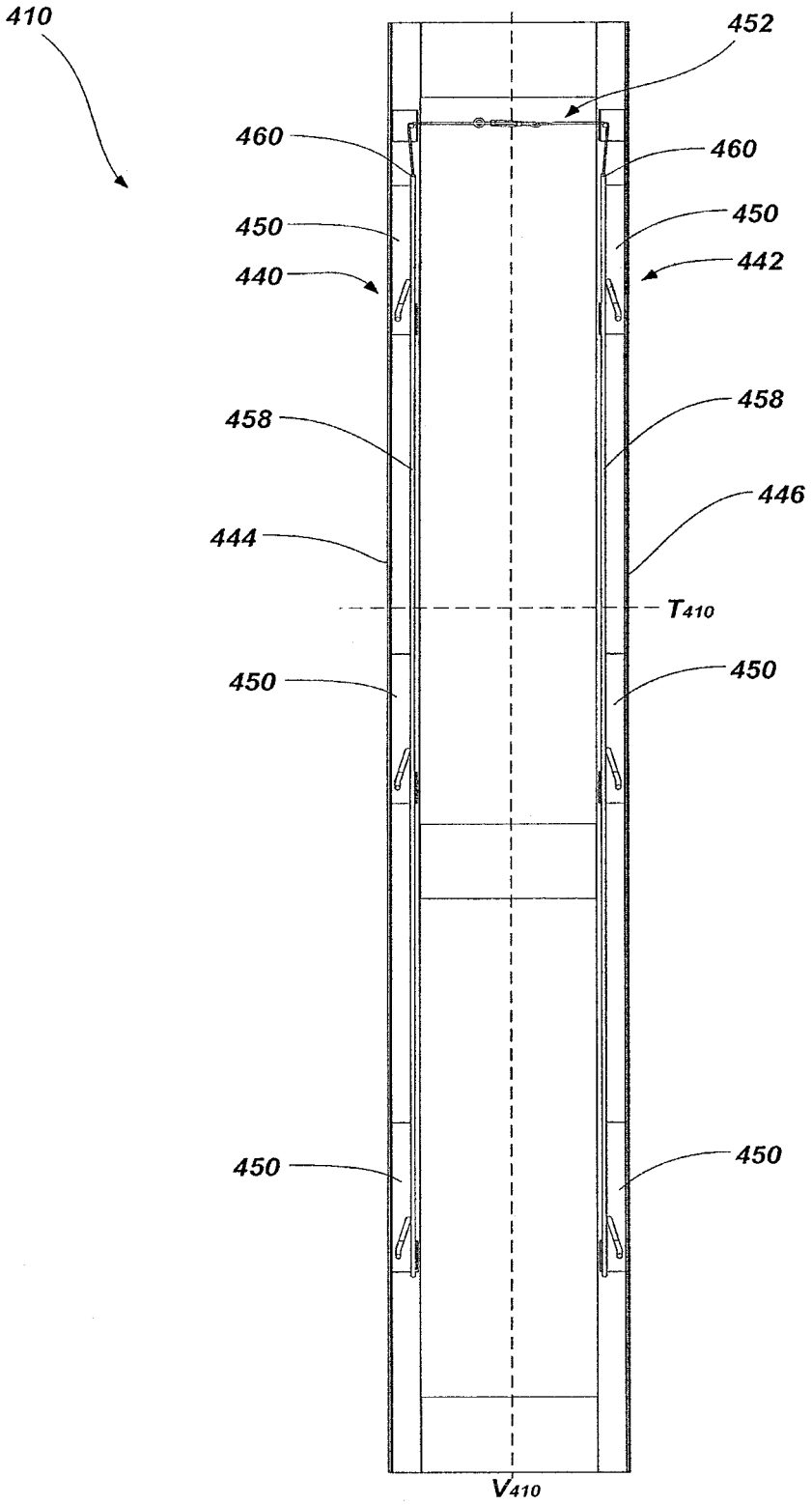
FIG. 7 is a cross-sectional side view of a portion of a movable partition system (e.g., a leading end assembly) including a closure assembly in accordance with yet another embodiment of the present invention.

FIG. 7 is a cross-sectional view of yet another embodiment of a closure assembly for a movable partition system. As shown in FIG. 7, a portion of a movable partition system such as, for example, a leading end assembly 410 having a vertical axis $V_{410}$ (e.g., longitudinal axis of the leading end assembly 410) and a transverse (e.g., lateral) axis $T_{410}$ may include a closure assembly. The closure assembly may include a first latching member 440 and a second latching member 442, which may be configured as any of the latching members 140, 142, 240, 242, 340, 342 described herein with reference to FIGS. 2 through 6. In other words, in some embodiments, the first and second latching members 440, 442 may be configured to be disposed at least partially within the leading end assembly 410 as shown in FIG. 7 and, in other embodiments, the first and second latching members 440, 442 may be configured to be disposed at least partially within a door jamb (e.g., door jambs 218, 318 as shown in FIGS. 5 and 6). The first and second latching members 440, 442 may include one or more latching portions (e.g., side latching portions 450). The side latching portions 450 may be positioned at intervals (e.g., equally spaced intervals) along side of the leading end assembly 410. For example, three side latching portions 450 may be positioned along a first side 444 of the leading end assembly 410 and three side latching portions 450 may be positioned along a second side 446 of the leading end assembly 410.

Figure 9:
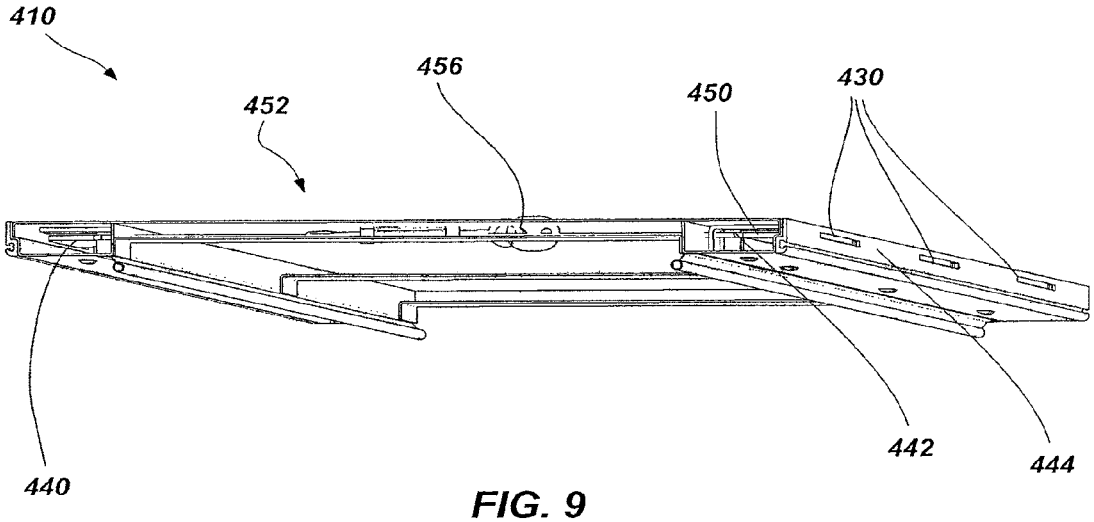
FIG. 9 is an isometric view of the leading end assembly including the closure assembly shown in FIG. 7.

In some embodiments, the side latching portions 450 of the first and second latching members 440, 442 may be coupled together by an elongated member 458. For example, the elongated member 458 of each of the first and second latching members 440, 442 may extend vertically along a portion of the leading end assembly 410 (e.g., along the vertical axis $V_{410}$). The side latching portions 450 may be coupled (e.g., welded, fastened, etc.) to the elongated members 458 and may extend laterally along (e.g., along the transverse axis $T_{410}$) a portion of the leading end assembly 410 to a location proximate to a side 444, 446 of the leading end assembly 410 (e.g., proximate to an opening 430 formed in a side 444, 446 of the leading end assembly 410 as shown in FIGS. 7 and 9).

The closure assembly may include a retaining assembly 452 that retains the first and second latching members 440, 442 in an initial position (e.g., a retracted position). The retaining assembly 452 may be coupled to a portion of the first and second latching members 440, 442. For example, the retaining assembly 452 may be coupled to a proximal portion 460 of each first and second latching members 440, 442 and may retain the elongated member 458 and each of the side latching portions 450 of the first and second latching members 440, 442 in the retracted position.

As discussed below in further detail, in operation, the retaining assembly 452 may release the first and second latching members 440, 442 enabling a portion of the first and second latching members 440, 442 to displace in a lateral direction. For example, releasing the first and second latching members 440, 442 may enable the first and second latching members 440, 442 to displace vertically under a force (e.g., a gravitational force). The first and second latching members 440, 442 may also be configured (e.g., by a combination of recesses 462 and guides 464 (FIG. 8)) to displace in a lateral direction as the first and second latching members 440, 442 displace in a vertical direction. The lateral displacement of the first and second latching members 440, 442 may extend a portion of the first and second latching members 440, 442 (e.g., the side latching portions 450) from the leading end assembly 410 in order to secure the leading end assembly 410 to an adjacent structure.

Figure 8:
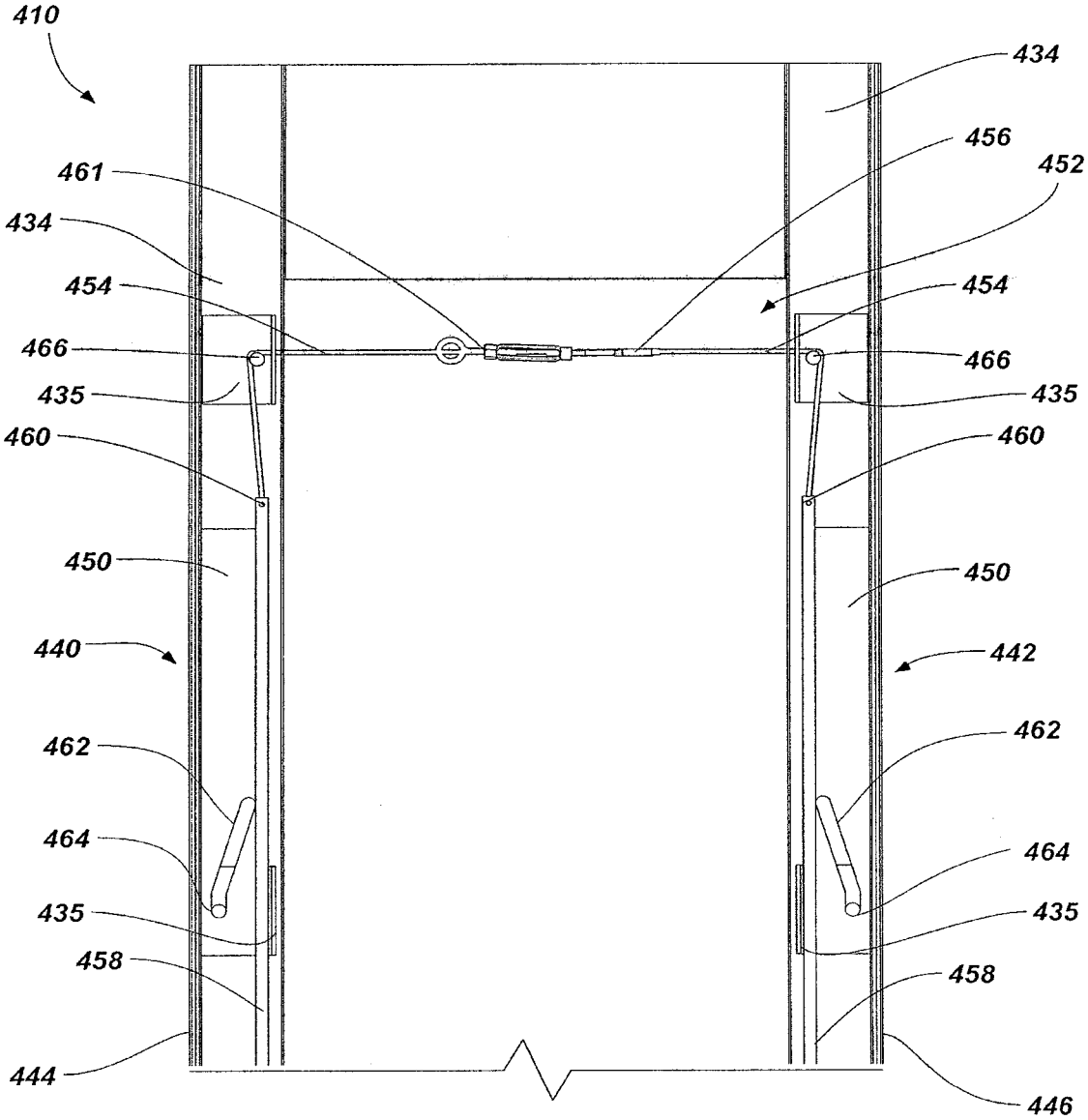
FIG. 8 is an enlarged, partial cross-sectional side view of the leading end assembly including the closure assembly shown in FIG. 7.

FIG. 8 is an enlarged, partial cross-sectional view of the closure assembly shown in FIG. 7. As shown in FIG. 8, the side latching portions 450 may be coupled to the elongated member 458 and extend therefrom in a lateral direction to an area proximate to a side 444, 446 of the leading end assembly 410. A portion of each of the first and second latching members 440, 442 may be coupled to the retaining assembly 452. In some embodiments, the retaining assembly 452 may include one or more elements (e.g., cables 454) coupled to the first and second latching members 440, 442. For example, the retaining assembly 452 may include one or more volumes of material configured to melt at a predetermined temperature (e.g., fusible link 456) that may be coupled to the cables 454 and may act to retain the first and second latching members 440, 442 in the retracted position. In some embodiments, the first and second latching members 440, 442 may be supported by the cables 454 that are connected together by the fusible link 456. For example, the cables 454 may extend from the first and second latching members 440, 442 and may be coupled together by the fusible link 456. A portion of each cable 454 may extend from one of the first and second latching members 440, 442 parallel to the vertical axis $V_{410}$ (FIG. 7) of the leading end assembly 410 to a post 466 coupled to a portion of a frame member 434 (e.g., a mounting tab 435) of the leading end assembly 410. The post 466 may be used to redirect the cable 454 to extend in a lateral direction (e.g., parallel to the transverse axis $T_{410}$ (FIG. 7)) of the leading end assembly 410 to meet with the fusible link 456 and another cable 454 extending from an associated, latching member 440, 442.

Figure 8A:
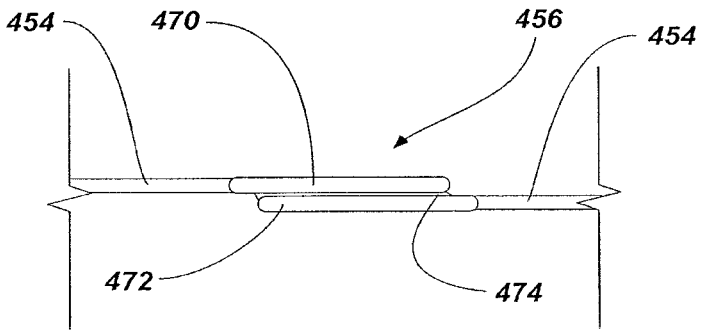
FIG. 8A is an enlarged view of a portion of the closure assembly shown in FIG. 8.

FIG. 8A is an enlarged view of the fusible link 456 of the closure assembly shown in FIG. 8. Referring to FIGS. 8 and 8A, the fusible link 456 may include a first member 470 coupled to the first latching member 440 (e.g., coupled to a cable 454 which is coupled to the first latching member 440), a second member 472 coupled to the second latching members 442 (e.g., coupled to a cable 454 which is coupled to the second latching member 442), and a fusible material 474 positioned between the first member 470 and the second member 472. The fusible material 474 of the fusible link 456 may be configured to melt at a predetermined temperature. For example, the fusible material 474 of the fusible link 456 may include a metal alloy configured to melt at a predetermined temperature of about 125 degrees F. (52 degrees C.) or greater. As the fusible link 456 approaches the predetermined temperature, the fusible material 474 will begin to melt enabling the fusible material 474 to deform. As the predetermined temperature is reached or thereafter, the fusible material 474 will fail causing the first and second members 470, 472 to separate, thereby, releasing the cables 454 and enabling the first and second latching members 440, 442 to displace into an extended position.

Referring again to FIG. 8, in some embodiments, the retaining assembly 452 may include an adjustment feature 461 such as, for example, a turnbuckle configured to adjust the initial position of the first and second latching members 440, 442.

In some embodiments, the first and second latching members 440, 442 may include a recess 462 (e.g., groove, channel, slot, etc.) formed in a portion of the first and second latching members 440, 442. For example, one or more of the side latching portions 450 of the first and second latching members 440, 442 may include a recess 462 formed therein. The recess 462 may be sized to receive a guide 464 therein. For example, the leading end assembly 410 may include a plurality of guides 464 coupled to a portion of the leading end assembly 410 (e.g., mounting tabs 435 of the frame member 434). Each guide 464 may be received in a recess 462 formed in the first and second latching members 440, 442. Each recess 462 and guide 464 combination may act to cooperatively displace the first and second latching members 440, 442 associated therewith laterally along (e.g., along the transverse axis $T_{410}$ (FIG. 7)) the leading end assembly 410. For example, the recesses 462 may be at least partially diagonal shaped (with respect to a vertical axis of the leading end assembly 410) such that a force (e.g., a gravitational force) may displace the recesses 462 of the first and second latching members 440, 442 along the guides 464, thereby, laterally displacing the first and second latching members 440, 442 along the leading end assembly 410 to the extended position. In other words, the first and second latching members 440, 442 may be positioned in order to exhibit a greater amount of potential energy in a retracted position than in an extended position. When the first and second latching members 440, 442 are released by the fusible link 456, a gravitational force may act on and displace the first and second latching members 440, 442 along the guides 464. Furthermore, the recesses 462 and guides 464 may displace a portion of the first and second latching members 440, 442 (e.g., the side latching portions 450) to at least partially extend from the leading end assembly 410 in an extended position (e.g., a latched position) as shown in FIGS. 3 through 6. It is noted that, in the configuration described above, the guides 464 may also displace the first and second latching members 440, 442 in the vertical direction (e.g., along the vertical axis $V_{410}$ (FIG. 7)). In such an embodiment, the side latching portions 450 may be positioned above openings 430 (FIG. 9) in the leading end assembly 410 through which portions of the side latching portions 450 are intended to extend. The guides 464 and recesses 462 may direct the first and second latching members 440, 442 both vertically and laterally along the leading end assembly 410 in order to extend portions of the side latching portions 450 from the leading end assembly 410.

In some embodiments, the recesses 462 may include a vertical section (i.e., a section extending along a vertical axis of the leading end assembly 410 that may enable the first and second latching members 440, 442 to be positioned in the leading end assembly 410 without extending (i.e., laterally extending) portions of the side latching portions 450 from the leading end assembly 410. The vertical sections of the recesses 462 may also provide an amount of tolerance for the retaining assembly 452 by, for example, enabling the cables 454 to stretch or the adjustment feature 460 to be adjusted without displacing the first and second latching members 440, 442 into an extended position.

FIG. 9 is an isometric view of the leading end assembly including the closure assembly shown in FIG. 7. As shown in FIG. 9, openings 430 may be formed in the leading end assembly 410 in order to enable the side latching portions 450 of the first and second latching members 440, 442 to extend from the leading end assembly 410 through the openings 430. For example, the leading end assembly 410 may include one or more openings 430 formed in one or more sides 444 of the leading end assembly 410. In operation, the retaining assembly 452 (e.g., the fusible link 456) may release the first and second latching members 440, 442 and enable portions of the side latching portions 450 to move outwardly away from the sides 444, 446 (FIG. 7) of the leading end assembly 410. For example, the fusible link 456 may release the first and second latching members 440, 442 when the fusible link 456 is heated to the predetermined temperature. As discussed above, in the extended position, the first and second latching members 440, 442 may latch or otherwise secure the leading end assembly 410 to an associated receiving assembly (e.g., strike moldings 148 (FIG. 2), door jambs 218, 318 (FIGS. 5 and 6), etc.).

Figure 10:
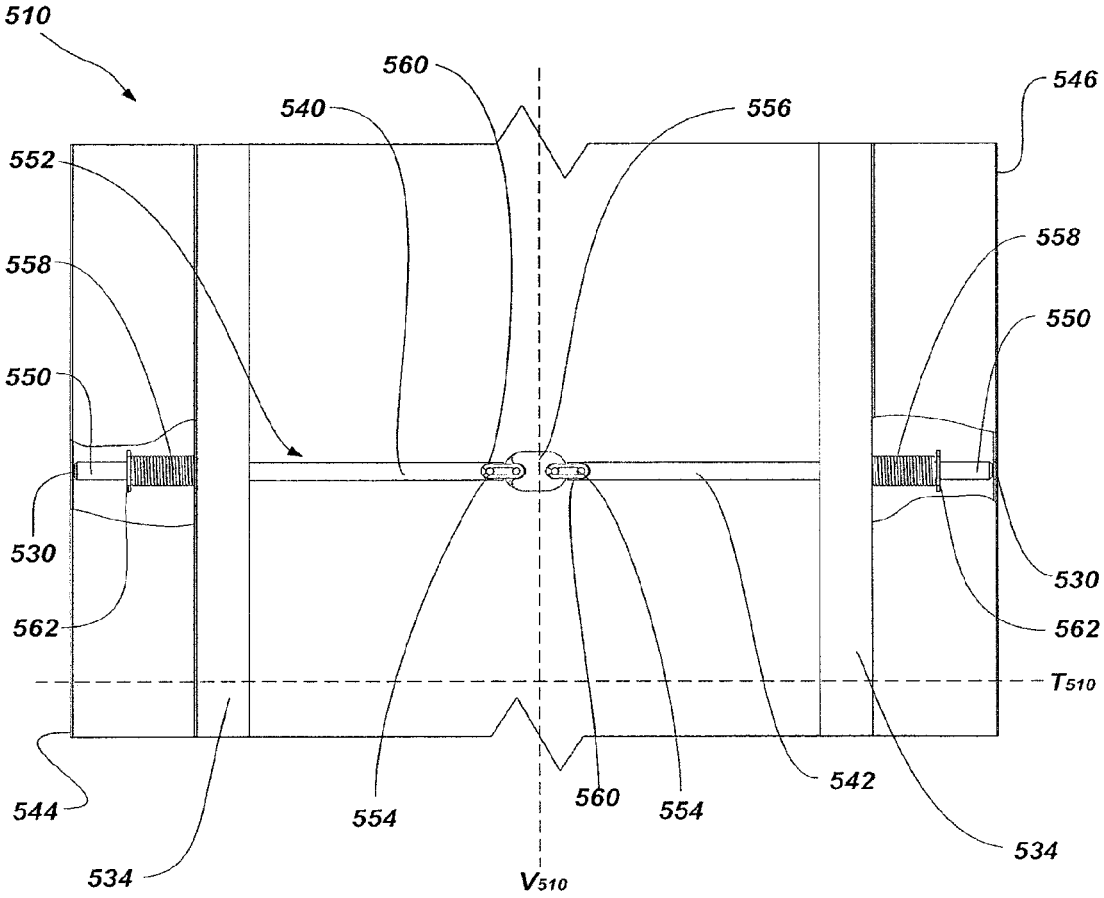
FIG. 10 is an enlarged, partial cross-sectional side view of a portion of a movable partition system (e.g., a leading end assembly) including a closure assembly in accordance with yet another embodiment of the present invention.

FIG. 10 is an enlarged, cross-sectional view of a portion of a movable partition system (e.g., a leading end assembly) including a closure assembly. As shown in FIG. 10, a portion of a movable partition system such as, for example, a leading end assembly 510 having a vertical axis $V_{510}$ and a transverse (e.g., lateral) axis $T_{510}$ may include a closure assembly. The closure assembly may include a first latching member 540 and a second latching member 542, which may be configured as any of the latching members 140, 142, 240, 242, 340, 342 described herein with reference to FIGS. 2 through 6. In other words, in some embodiments, the first and second latching members 540, 542 may be configured to be disposed at least partially within the leading end assembly 510 as shown in FIG. 10 and, in other embodiments, the first and second latching members 540, 542 may be configured to be disposed at least partially within a door jamb (e.g., door jambs 218, 318 as shown in FIGS. 5 and 6). The first and second latching members 540, 542 may comprise elongated members (e.g., an elongated cylinder) including one or more latching portions (e.g., side latching portions 550). In some embodiments, the first and second latching members 540, 542 may extend laterally (e.g., in a direction at least substantially parallel to the transverse axis $T_{510}$) along a portion of the leading end assembly 510. The side latching portions 550 may be positioned on a distal portion of the first and second latching members 540, 542. The first and second latching members 540, 542 may be positioned in the leading end assembly 510 such that each of the side latching portions 550 are positioned along either a first side 544 of the leading end assembly 510 or a second side 546 of the leading end assembly 510. The side latching portions 550 may be configured to extend from the sides 544, 546 of the leading end assembly 510 to an extended position in order to secure (e.g., latch) the leading end assembly 510.

The closure assembly may include a retaining assembly 552 that retains the first and second latching members 540, 542 in an initial position (e.g., a retracted position). The retaining assembly 552 may be coupled to a portion of the first and second latching members 540, 542. For example, a proximal portion 560 of each of the first and second latching members 540, 542 may be coupled to the retaining assembly 552. The retaining assembly 552 may retain the first and second latching members 540, 542 in the initial position. In some embodiments, the retaining assembly 552 may include one or more elements (e.g., master links 554 such as, for example, an ANSI number 40 single strand roller chain connecting link) coupled to the first and second latching members 540, 542. In some embodiments, the retaining assembly 552 may include a fusible link 556 that may be coupled to the master links 554 and may act to retain the first and second latching members 540, 542 in the initial position.

Similar to the fusible link 456 described above with reference to FIG. 8, the fusible link 556 may include a fusible material that is configured to melt at a predetermined temperature.

In some embodiments, the first and second latching members 540, 542 may be biased in an extended position by biasing members (e.g., springs 558). For example, the springs 558 may be disposed around a portion of the first and second latching members 540, 542. The first and second latching members 540, 542 may include flange portions 562 positioned proximate to the distal portions of the first and second latching members 540, 542. A first end of the springs 558 may be positioned adjacent to the flange portions 562. A second end of the springs 558 may be positioned adjacent to a portion of the leading end assembly 510 (e.g., the frame member 534) such that the first and second latching members 540, 542 are biased in the extended position. For example, when the first and second latching members 540, 542 are positioned in the retracted position within the leading end assembly 510, the springs 558 are compressed between the flange portions 562 and the frame member 534 of the leading end assembly 510. In other words, the first and second latching members 540, 542 may be positioned in order to exhibit a greater amount of potential energy in a retracted position than in an extended position. The first and second latching members 540, 542 are coupled to the fusible link 556, which substantially counteracts the force of the springs 558 and retains the side latching portions 550 of the first and second latching members 540, 542 in the retracted position. When the fusible link 556 releases the first and second latching members 540, 542, the springs 558 force the side latching portions 550 of the first and second latching members 540, 542 into the extended position. For example, the springs 558 may force the side latching portions 550 through openings 530 formed in the leading end assembly 510 such that the side latching portions 550 extend from the leading end assembly 510 (e.g., extending at least substantially parallel to the transverse axis $T_{510}$ of the leading end assembly 510). It is noted that, in some embodiments, the biasing members such as, for example, the springs 558 may be provided with additional protection from heat sources in order to ensure that the springs 558 operate properly at the high temperatures experienced during a fire. For example, the springs 558 may be formed from, or insulated with, a heat resistant material or may be disposed within a structure (e.g., a portion of the leading end assembly 510 or the door jambs 218, 318 (FIGS. 5 and 6)) that is formed from, or insulated with, a heat resistant material.

Figure 11:
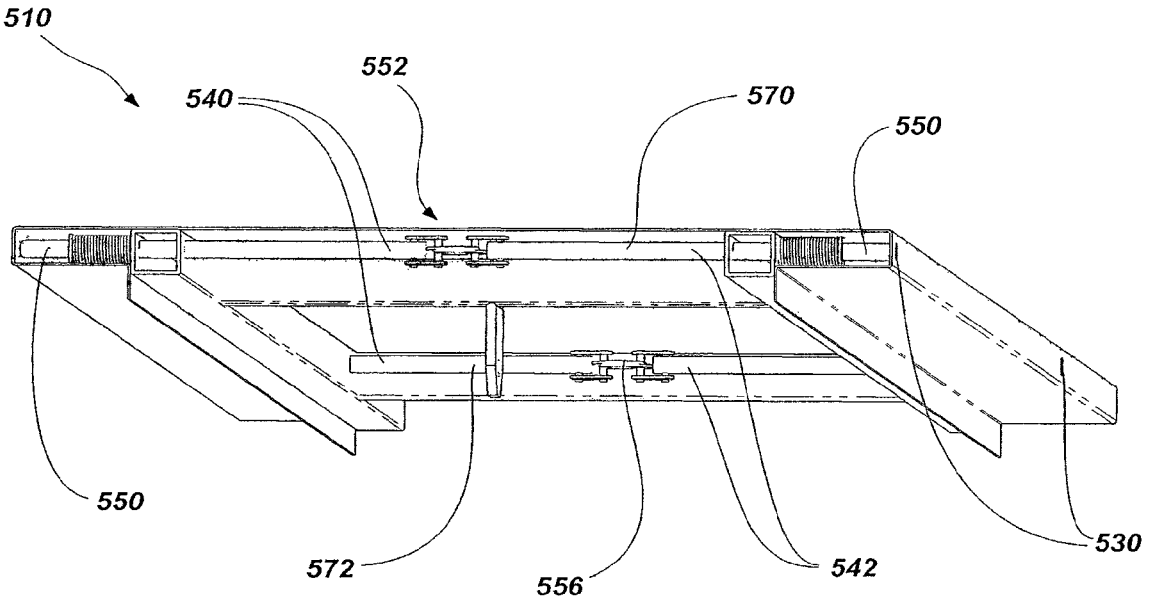
FIG. 11 is an isometric view of the leading end assembly including the closure assembly shown in FIG. 10.

FIG. 11 is an isometric view of the leading end assembly including the closure assembly shown in FIG. 10. As shown in FIG. 11, the openings 530 may be formed in the leading end assembly 510 in order to enable the side latching portions 550 of the first and second latching members 540, 542 to extend from the leading end assembly 510. In operation, the retaining assembly 552 (e.g., the fusible link 556) may release the first and second latching members 540, 542 and enable the side latching portions 550 to move outwardly away from the leading end assembly 510. As discussed above, in the extended position, the first and second latching members 540, 542 may latch or otherwise secure the leading end assembly 510 to a receiving assembly (e.g., strike moldings 148 (FIG. 2), door jambs 218, 318 (FIGS. 5 and 6), etc.).

As shown in FIG. 11, in some embodiments, the leading end assembly 510 may include one or more sets of first and second latching members 540, 542. For example, the leading end assembly 510 may include a first set 570 of first and second latching members 540, 542 and a second set 572 of first and second latching members 540, 542. In some embodiments, the first and second sets 570, 572 of latching members 540, 542 may be positioned at intervals (e.g., equally spaced intervals) along an axis of the leading end assembly 510.

Figure 12:
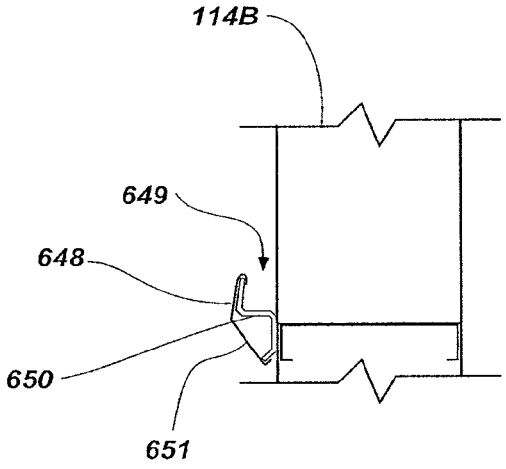
FIG. 12 is a cross-sectional top view of an embodiment of a strike molding coupled to a structure for use with a movable partition system including a closure assembly in accordance with embodiments of the current invention.

FIG. 12 is a cross-sectional top view of an embodiment of a strike molding coupled to a structure for use with a movable partition system including a closure assembly. As shown in FIG. 12, a portion of a latching member (e.g., latching members 140, 142, 240, 242, 340, 342, 440, 442, 540, 542) may be received within a strike molding 648 having an opening 649 formed therein to receive portions of a latching member. The strike molding 648 may be coupled to a portion of the opposing wall 114B. The strike molding 648 may include a base portion 650 having a substantially S-shaped or Z-shaped cross section and a cover 651. In some embodiments, the cover 651 may substantially conceal base portion 650 and fasteners connecting base portion 650 to the opposing wall 114B to increase the aesthetic appeal of the strike molding 648.

In view of the foregoing, a closure assembly may be provided that improves the reliability, safety, and visual aesthetics of a movable partition system, especially when the movable partition system is implemented as a fire barrier. The closure assembly may prevent the separation of the leading end assembly and an adjacent structure and may maintain an appropriate fire barrier, even under the heat of a fire. As previously mentioned, when temperatures of portions of a movable partition system substantially increase, such as during a fire, there is a possibility that the leading end assembly and an adjacent structure will warp and may separate. To prevent this separation, a closure assembly may be provided to secure the leading end assembly to an adjacent structure. However, securing the leading end assembly to an adjacent structure may not always be desirable, for example, when people may be fleeing the fire and must open the movable partition to escape. In view of this, the present invention provides a temperature sensitive locking apparatus, which may secure the leading end assembly to an adjacent structure together only when the temperature of a portion of the movable partition system reaches a predetermined temperature. This predetermined temperature may be less than the temperature that causes warping of the leading end assembly to ensure that the leading end assembly is secured by the time the leading end assembly reaches warping temperature, but may also be sufficiently high to ensure that the locking apparatus does not prevent persons from attempting to escape the fire.

Additionally, closure assemblies may be provided that may be contained within the leading end assembly of a movable partition or in an associated door jamb, thereby decreasing the complexity of installation of the movable partition system. For example, a closure assembly contained in a leading end assembly may only require installation of a strike mount on an adjacent wall in order to latch a movable partition thereto. Further, the closure assembly may be substantially enclosed within the leading end assembly or door jamb, which may prevent tampering or inadvertent damage of the closure assembly. The leading end assembly including a closure assembly may eliminate the need for a separate pocket door cover and hardware to cover the movable partition stored in a retracted state in the pocket. Thus, the leading end assembly may provide a pocket cover and leading end of the partition in one element, thereby, decreasing the size of the movable partition when it is stowed in a retracted state and increasing the ease of installation and use of the movable partition.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, legal equivalents, and alternatives falling within the spirit and scope of the invention as defined by the following appended claims. For example, it is contemplated that elements and features of one embodiment may be combined with the elements and features of other disclosed embodiments.

What is claimed is:

1. A method of securing a movable partition, the method comprising:

retaining a first latching member and a second latching member in a retracted position by coupling the first latching member to the second latching member;

positioning the movable partition comprising a plurality of hingedly coupled panels movably coupled to a track and a leading end assembly coupled to at least one panel of the plurality of hingedly coupled panels in an extended position; and while the movable partition is in the extended position, extending the first latching member and the second latching member to an extended position, comprising:

extending the first latching member in a first direction to engage with an opening formed in a receiving assembly; and extending the second latching member in a second direction to engage with another opening formed in the receiving assembly.

2. The method of claim 1, further comprising positioning the first latching member and the second latching member to have a greater amount of potential energy in the retracted position than in the extended position.

3. The method of claim 2, wherein positioning the first latching member and the second latching member comprises biasing the first latching member and the second latching member into the extended position.

4. The method of claim 2, wherein positioning the first latching member and the second latching member comprises positioning the first latching member and the second latching member to have a greater amount of gravitational potential energy in the retracted position than in the extended position.

5. The method of claim 1, wherein retaining a first latching member and a second latching member in a retracted position comprises retaining the first latching member and the second latching member at least partially within a leading end assembly of the movable partition.

6. The method of claim 1, wherein retaining a first latching member and a second latching member in a retracted position comprises retaining the first latching member and the second latching member at least partially within a door jamb external to the movable partition.

7. The method of claim 1, further comprising heating a portion of the movable partition to a predetermined temperature to release the first latching member and the second latching member from the retracted position.

8. The method of claim 3, further comprising heating a portion of the movable partition to a predetermined temperature to melt at least one volume of material retaining the first latching member and the second latching member in the retracted position.

9. The method of claim 8, further comprising releasing a coupling between the first latching member and the second latching member by melting the at least one volume of material.

10. The method of claim 1, further comprising heating a portion of the movable partition to a predetermined temperature to melt at least one volume of material retaining the first latching member and the second latching member in the retracted position.

11. The method of claim 1, further comprising retaining the first latching member and the second latching member in the retracted position entirely within a housing of a leading end assembly of the movable partition.

12. The method of claim 1, wherein extending the first latching member comprises extending the first latching member from a first lateral side of a leading end assembly of the movable partition along a plane in a first direction, wherein the plane extends in a direction transverse to an intended direction of travel of a plurality of hingedly coupled panels of the movable partition along a track to which the plurality of hingedly coupled panels are coupled, and wherein extending the second latching member comprises extending the second latching member from a second lateral side of the leading end assembly of the movable partition opposing the first lateral side along the plane in a second direction opposing the first direction.

13. The method of claim 1, further comprising:

extending at least one first additional latching member from a first lateral side of a leading end assembly of the movable partition; and extending at least one second additional latching member from a second lateral side opposing the first lateral side of the leading end assembly of the movable partition.

14. A method of securing a movable partition, the method comprising:

extending the movable partition and a leading end assembly of the movable partition along a track to an extended state where the leading end assembly is positioned at an opposing wall, the movable partition comprising a first structure of hingedly coupled panels and a second structure of hingedly coupled panels that is laterally spaced from and extends generally parallel to the first structure wherein the leading end assembly is coupled to both the first structure and the second structure, and wherein a leading surface of the leading end assembly exhibits a width, taken a direction transverse to a direction of travel of the movable partition to the extended state, substantially equal to or greater than a corresponding width of a portion of the movable partition trailing the leading end assembly;

retaining a first latching member and a second latching member of a latching assembly coupled to the leading end assembly in a retracted coupling the first latching member to the second latching member; and extending the first latching member and the second latching member to an extended position, comprising:

extending the first latching member in a first direction to engage with an opening formed in a receiving assembly; and extending the second latching member in a second direction to engage with another opening formed in the receiving assembly.

15. The method of claim 14, further comprising abutting the leading surface comprising a substantially planar surface of the movable partition to the opposing wall when the movable partition is in the extended state.

16. The method of claim 14, wherein extending the first latching member comprises positioning a portion of the first latching member in the opening formed in a first strike molding of the receiving assembly coupled to the opposing wall and wherein extending the second latching member comprises positioning a portion of the second latching member in the another opening formed in a second strike molding of the receiving assembly coupled to the opposing wall.

17. The method of claim 14, wherein extending the first latching member comprises positioning a portion of the first latching member in the opening formed in the opposing wall and wherein extending the second latching member comprises positioning a portion of the second latching member in the another opening formed in the opposing wall.

18. A method of securing a movable partition, the method comprising:

extending a leading end assembly and a plurality of hingedly coupled panels of the movable portion along a track to an extended state;

retaining a first latching member and a second latching member in a retracted position by coupling the first latching member to the second latching member; and extending the first latching member and the second latching member to an extended position, comprising:

extending the first latching member in a first direction to engage with an opening formed in a receiving assembly; and extending the second latching member in a second direction to engage with another opening formed in the receiving assembly, wherein extending the first latching member comprises extending the first latching member from a first lateral side of the leading end assembly along a plane in a first direction in a direction transverse to the track, and wherein extending the second latching member comprises extending the second latching member from a second lateral side of the leading end assembly of along the plane in a second direction opposing the first direction.

19. The method of claim 18, further comprising abutting a planar leading surface of the leading end assembly of the movable partition to an opposing wall when the movable partition is in the extended state.

20. The method of claim 19, wherein extending the first latching member in a first direction comprises translating the first latching member in a plane substantially parallel to the planar leading surface of the leading end assembly, and extending the second latching member in a second direction comprises translating the second latching member in the plane substantially parallel to the planar leading surface of the leading end assembly.

* * * * *